US005297339A

United States Patent [19]

Morgenstern et al.

[11] Patent Number: 5,297,339

[45] Date of Patent: Mar. 29, 1994

[54] FIXTURE FOR TERMINATING MINIATURE COAXIAL CABLE

[75] Inventors: Todd A. Morgenstern, Bloomington; James D. Dewey, Plymouth; James D. Bradley, Mound, all of Minn.

[73] Assignee: ADC Telecommunications, Inc., Minneapolis, Minn.

[21] Appl. No.: 997,692

[22] Filed: Dec. 28, 1992

[51] Int. Cl.[5] ..... B25B 11/02

[52] U.S. Cl. ..... 29/281.1; 29/281.5; 269/43

[58] Field of Search ..... 29/739, 747, 760, 237, 29/281.1, 281.5; 269/43, 45, 99, 100, 296, 287, 903, 902

[56] References Cited

U.S. PATENT DOCUMENTS

| | | | |
|---|---|---|---|
| 568,543 | 9/1896 | Parks | 269/45 |
| 1,556,882 | 10/1925 | Weaver | 269/16 |
| 2,599,010 | 6/1952 | Pernitz | 269/100 |
| 2,774,134 | 12/1956 | Smith et al. | 269/45 |
| 3,086,767 | 4/1963 | Boser | 269/45 |
| 3,813,749 | 6/1974 | Peake et al. | 269/287 |
| 4,079,927 | 3/1978 | Rocton | 269/296 |
| 4,092,019 | 5/1978 | Young | 269/403 |
| 4,575,061 | 3/1986 | Dille | 269/45 |

*Primary Examiner*—Robert C. Watson

*Attorney, Agent, or Firm*—Merchant, Gould, Smith, Edell, Welter & Schmidt

[57] ABSTRACT

The present invention pertains to a fixture for terminating a miniature coaxial cable with a connector, and a kit for use with the fixture. The coaxial cable includes a center conductor and the connector has a connector center conductor which has a pin-shaped first end and a receiving member for receiving the central conductor of the coaxial cable. The fixture for terminating the coaxial table includes a base and a first beam and a second beam for holding the pin-shaped first end. The fixture also includes a third beam for holding the coaxial cable so that the center conductor of the coaxial cable can be inserted in the receiving member of the connector center conductor. The kit includes a working surface and a tray for holding parts of the connector.

9 Claims, 4 Drawing Sheets

FIXTURE FOR TERMINATING MINIATURE COAXIAL CABLE

FIELD OF THE INVENTION

The present invention pertains to a fixture for aiding in the termination or connectorization of a coaxial cable.

BACKGROUND OF THE INVENTION

Generally, connectorizing coaxial cables requires physically connecting the center conductor of the cable to the connector center conductor. Connectorizing can be done in a manufacturing environment or in the field by users who need to terminate cables at various lengths depending on equipment location.

Two common methods are used to physically connect the cable center conductor to the connector center conductor. The first method is by crimping the connector center conductor around the center conductor of the coaxial cable. An alternative method is by soldering the two center conductors together. Both methods are in widespread use, but generally the soldering method is more reliable. The quality of the soldered joint, however, varies from person to person. The crimp method is considered to be more consistent in quality, but not as reliable as a good solder connection.

A poor quality termination can result in poor performance of the connection. With today's demand for increased density telecommunications equipment, limitations are now being dictated by the size of the cables used to connect network equipment. There is an increasing trend to downsize cables to allow for easier cable management and cause less cable congestion. As both the cables and connectors are reduced in size, handling becomes an important issue when connectorizing the cables, and it becomes more difficult to achieve consistent quality terminations either by soldering or crimping.

Blocks with holes or pins have been used to hold the connector center conductor while soldering in a manufacturing environment. These fixtures, however, require the user to hold the coaxial cable and, thus, make the quality of the connection dependent upon the skill and manual dexterity of the user. Similarly, soldering vises are commonly used to hold the center conductor of the connector, which still requires the user to hold the coaxial cable.

SUMMARY OF THE INVENTION

This invention provides a fixture for improving the consistency of soldered connections. Use of the invention also decreases the time needed to connectorize a cable.

The present invention pertains to a fixture for terminating a coaxial cable with a connector. The coaxial cable has an axially-aligned center conductor and a distal end. The connector has a connector center conductor with a pin-shaped front end and an annular opening for receiving the center conductor of the coaxial cable disposed at the opposite end of the connector center conductor.

The fixture for terminating a miniature coaxial cable includes a base. The fixture also includes a first and a second beam each having a distal end. The first and second beams are approximately parallel to each other and disposed upwardly from the base. A first bore extends through the distal end of the first beam, and a second bore extends through the distal end of the second beam. Each bore is axially aligned with the other bore.

A third beam having a distal end is disposed upwardly from the base. The third beam includes a cutout proximate its distal end. The cutout is approximately axially-aligned with the first and second bores so that the pin-shaped end of the connector center conductor is insertable in the two axially-aligned bores with the annular opening being disposed toward the third beam. The coaxial cable is insertable in the cutout with the distal end of the coaxial cable being disposed toward and proximate the annular opening so that the center conductor of the coaxial cable is insertable in the receiving means.

The present invention also includes a kit for use with the fixture. The kit includes a working surface having an operably connected tray. The tray has at least one compartment. The tray can be used as the packaging for the connector. Push-pull fasteners are used to operably connect the fixture to the working surface.

DETAILED DESCRIPTION OF THE PREFERRED EMBODIMENT

Figure 1:
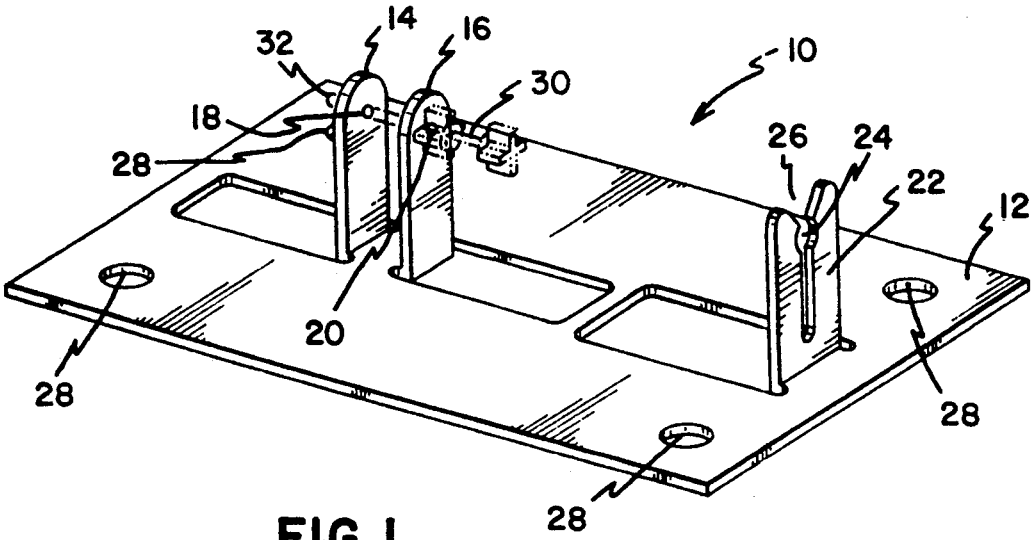
FIG. 1 shows a perspective view of a fixture for terminating a miniature coaxial cable with a connector center conductor shown in broken lines.

Referring now to the drawings, wherein like reference numerals designate identical parts throughout the several views, and more particularly to FIG. 1, showing a fixture for terminating a miniature coaxial cable generally designated as 10.

Fixture 10 includes a base 12 and a first and a second beam 14 and 16, respectively. Proximate and extending through the distal end of beam 14 is a first bore 18 and proximate and extending through the distal end of beam 16 is a second bore 20. Bore 18 is approximately axially aligned with bore 20.

Also extending from base 12 is a third beam 22. Third beam 22 has a generally circular cutout 24 approximately axially aligned with bores 18 and 20. Opening upwardly in the distal end of beam 22 is a V-shaped notch 26 extending downwardly into and through cutout 24.

Extending vertically through base 12 is at least one aperture 28. As shown in FIG. 1 of the preferred embodiment, the invention includes four apertures 28.

Preferably, fixture 10 is fabricated from a single piece of sufficiently sturdy metal. Also shown in FIG. 1 with hidden lines is a connector center conductor 30 having a pin-shaped first end 32 inserted through bores 18 and 20.

Figure 3:
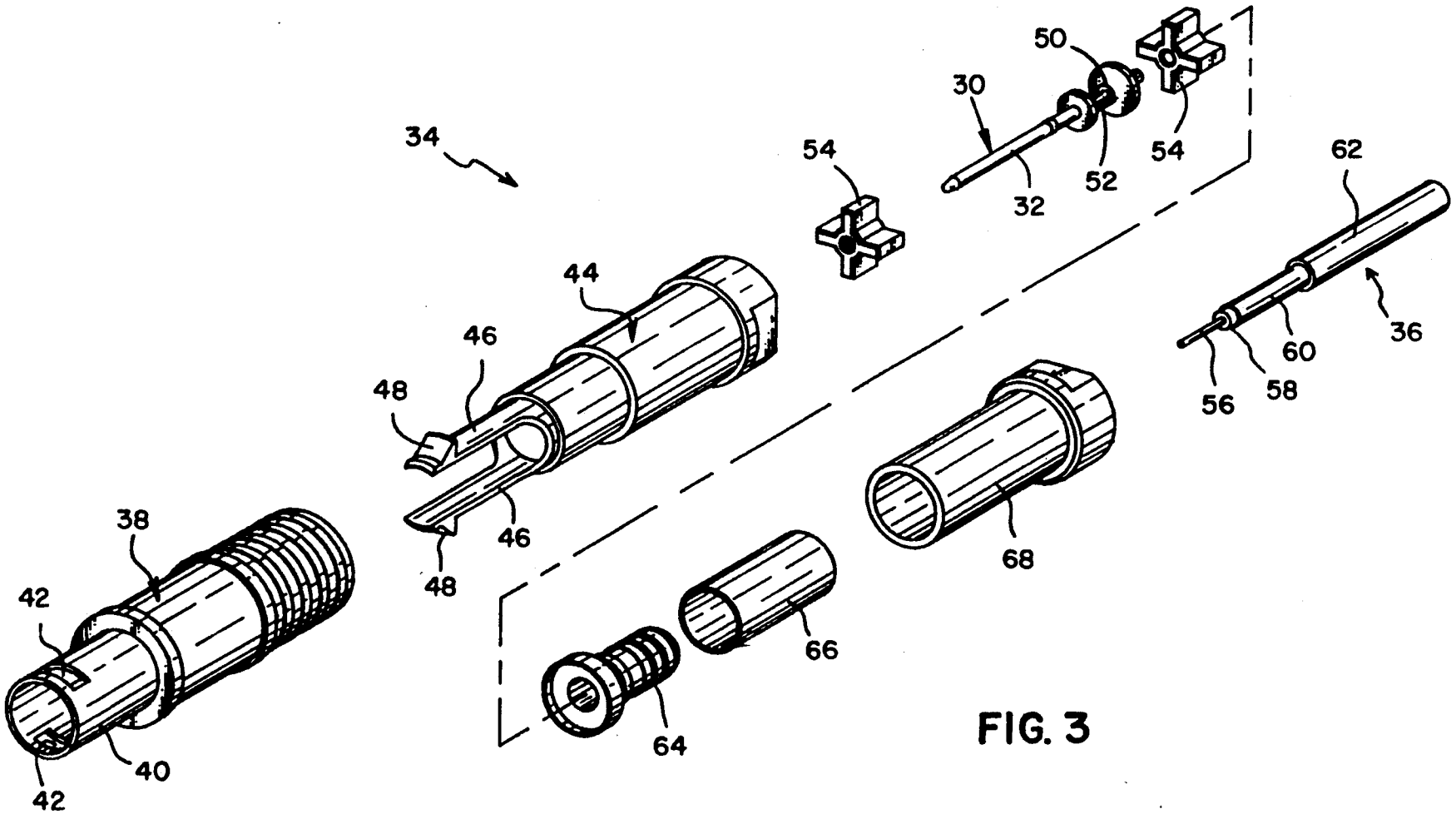
FIG. 3 shows an exploded perspective view of a typical connector.

FIG. 3 shows an expanded view of a typical connector, generally referred to by the numeral 34, and a typical coaxial cable, generally referred to by the numeral 36. Connector 34 and coaxial cable 36 are discussed here for purposes of illustrating the use of fixture 10 only. Other connector and coaxial cables embodiments having center conductors similar to the one discussed herein may also be used with fixture 10.

Connector 34, shown in FIG. 3, includes an outer jacket 38 having a reduced diameter portion 40 with oppositely disposed slots 42 proximate the distal end of portion 40. The connector 34 also includes a barbed insert 44 having barbs 46 with tabs 48 outwardly disposed proximate the distal end of each barb 46.

Connector center conductor 30, as shown in FIG. 3, includes pin-shaped first end 32 and a receiving means proximate the second end of connector center conductor 30. The receiving means includes an annular opening 50 and a solder channel 52. Slideably mounted on each end of connector center conductor 30 is a dielectric spacer 54. Connector 34 also includes a inner crimping member 64, outer crimping member 66, and a retaining sleeve 68.

As shown in FIG. 3, coaxial cable 36 includes a center conductor 56, an insulator 58, a ground shield 60, and an outer sheath 62. Insulator 58 surrounds conductor 56 insulating it from ground shield 60. Outer sheath 62 surrounds and protects ground shield 60.

Figure 4:
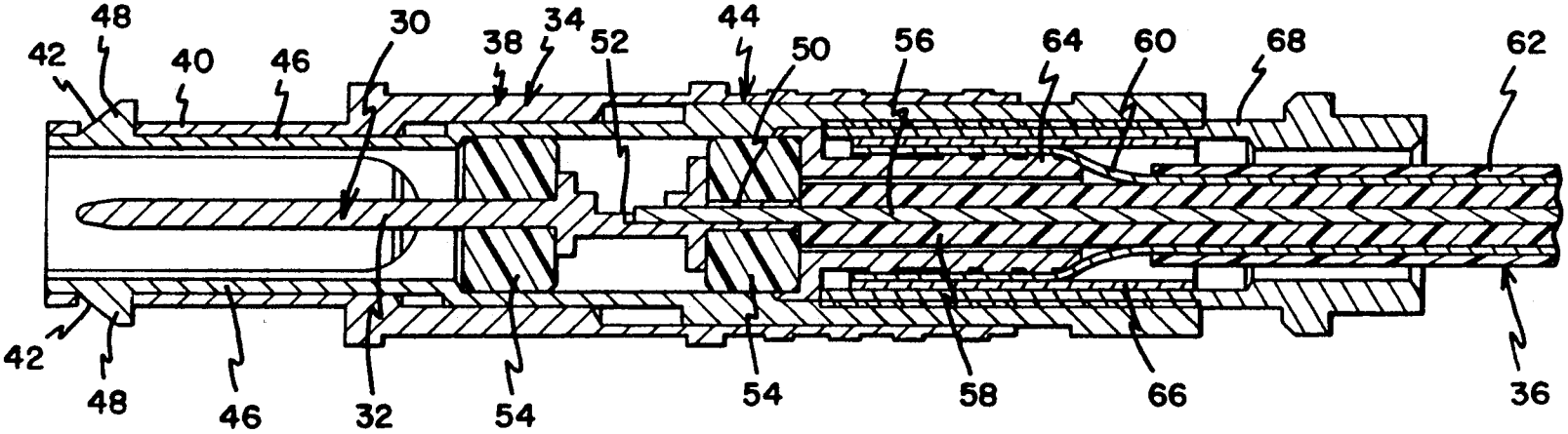
FIG. 4 shows a cross-section of the typical connector.

FIG. 4 shows a cross-section of connector 34 and coaxial cable 36 connectorized or assembled. In FIG. 4 barbed insert 44 is shown inserted into outer jacket 38, so that tabs 48 of barbs 46 are disposed through slots 42 of reduced diameter portion 40 of outer jacket 38. Reduced diameter portion 40 is insertable in a complementary connector (not shown) and tabs 48 help retain reduced diameter portion 40 in the complementary connector.

Center conductor 56 of coaxial cable 36 is shown inserted in annular opening 50 of connector center conductor 30. One dielectric spacer 54 is slideably mounted to pin-shaped first end 32 of connector center conductor 30 and the other dielectric spacer 54 is slideably mounted to the second end of connector center conductor 30. Center conductor 56 extends into solder channel 52 of connector center conductor 30 as shown.

Center conductor 56 and insulator 58 are shown inserted into inner crimping member 64. Ground sheath 60 of coaxial cable 36 is crimped between inner crimping member 64 and outer crimping member 66. Retaining sleeve 68 is held in barbed insert 44 by friction fit or, alternatively, by a screwed threading.

Figure 2:
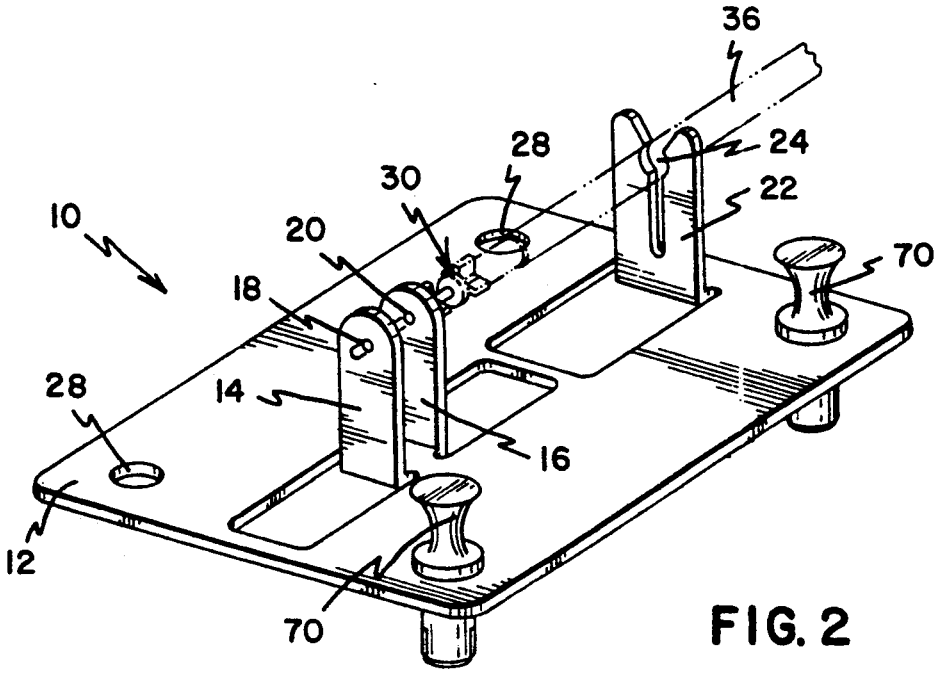
FIG. 2 shows a perspective view of the fixture for terminating the miniature coaxial cable with the connector center conductor and a coaxial cable shown in broken lines.

FIG. 2 is a perspective view of fixture 10 showing connector center conductor 30 inserted in bores 18 and 20 of beams 14 and 16, respectively. Coaxial cable 36 is shown inserted in cutout 24 of beam 22. One end of coaxial cable 36 is shown connected to connector center conductor 30. Inserted into two apertures 28 are push-pull pins 70. The operation of push-pull pins is well known to one skilled in the art.

Figure 5:
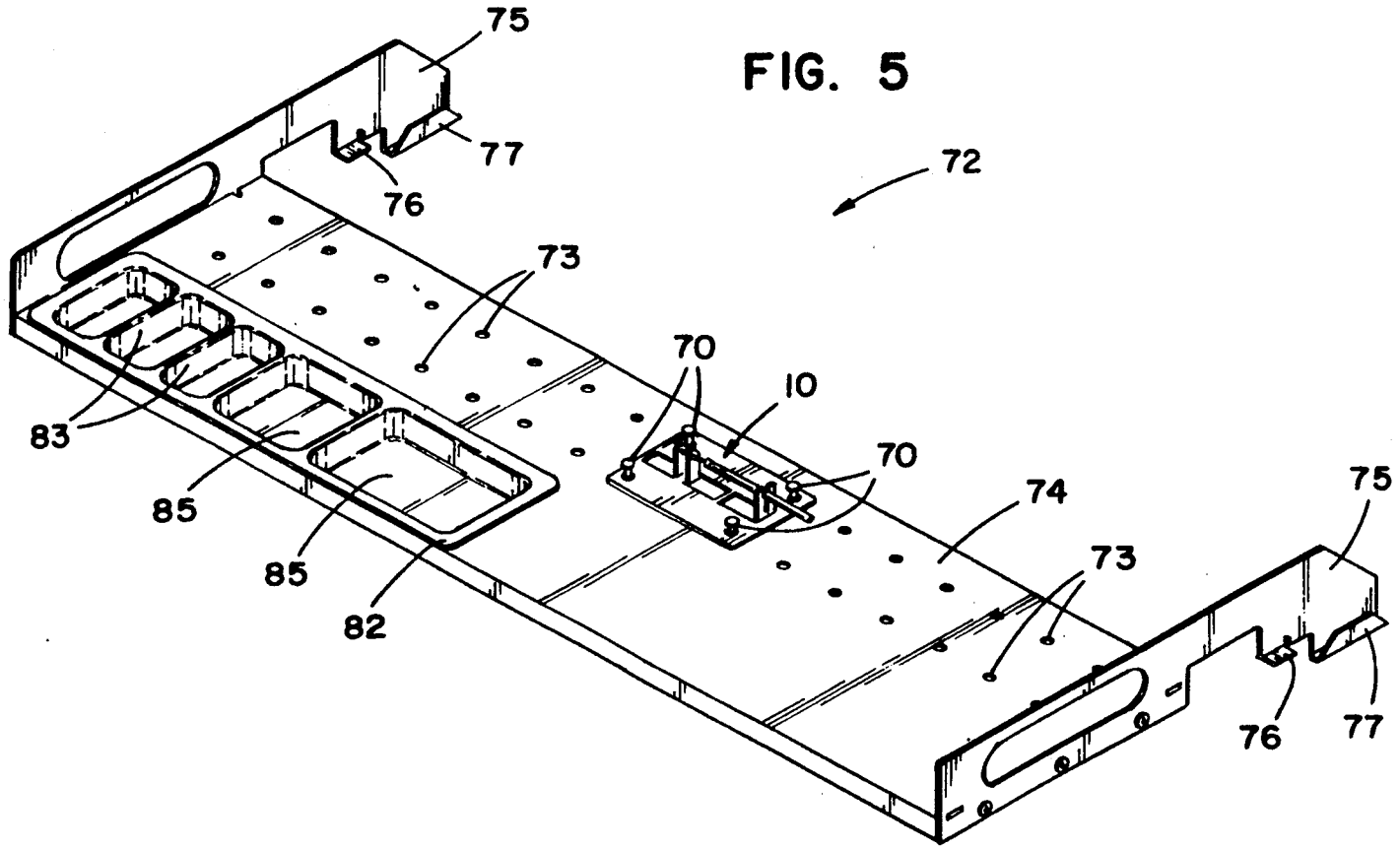
FIG. 5 shows a plurality of fixtures for terminating the miniature coaxial cable properly connected to a kit including a working surface and tray.

FIG. 5 shows a kit, generally referred to by numeral 72, for use with one or more fixtures 10. Kit 72 includes a generally rectangular working surface 74. Working surface 74 has connecting means for supporting the working surface. The connecting means includes two brackets 75 with bent tabs 76 and 77. On one side of working surface 74 is an integrally formed recess, not shown in FIG. 5, for holding a tray 82 having dividers 83 defining a plurality of pockets 85.

Operably connectable to working surface 74 is one or more fixtures 10. Each fixture 10 is preferably connected to working surface 74 with four push-pull pins 70. Although the preferred embodiment includes push-pull pins 70, it is understood that other fastening means could be used. Push-pull pins 70 are inserted into receiving orifices 73 in working surface 74. Tray 82 preferably has a plurality of pockets or compartments for holding different parts of connector 34. For example, a first compartment might contain outer jackets 38, a second compartment might contain barbed inserts 44, and so on.

In use, fixtures 10 can be used to terminate coaxial cables with or without kit 72. Working surface 74 of kit 72 can be removeably installed in the field on telecommunication equipment bays or the like. Bracket 75 supports work surface 74 while bend tabs 76 and 77 are attachable to the telecommunications equipment where the cables are being terminated. The use of bend tabs 76 and 77 allows the user to attach and remove the working surface 74 to the telecommunications equipment without fasteners. While the preferred embodiment consists of using bend tabs 76 and 77, it is understood that other attachment means could be used. Generally, only one fixture 10 is used with each working surface 74. Fixture 10 can be moved to various locations corresponding to receiving orifices 73 on working surface 74. This allows fixture 10 to be moved along the working surface to a location proximate the cables to be connectorized. It should be understood that fixture 10 can be used independently of working surface 74. For example, fixture 10 could be placed on a work bench.

To terminate a cable using fixture 10, pin-shaped first end 32 of connector center conductor 30 is inserted into second bore 20 and first bore 18 as shown in FIGS. 1 and 2. Cable 36 is then inserted into cutout 24 so that the distal end of cable 36 is disposed toward annular opening 50 of connector center conductor 30. Center conductor 56 of cable 36 is then inserted into annular opening 50 and solder channel 52. While fixture 10 retains cable 36 and connector center conductor 30, the user's hands are free to apply solder to center conductor 56 proximate channel 52.

While the present invention has been described in connection with the preferred embodiment thereof, it will be understood many modifications will be readily apparent to those skilled in the art, and this application is intended to cover any adaptations or variations thereof. It is manifestly intended this invention be limited only by the claims and equivalents thereof.

What is claimed is:

1. A fixture for terminating a miniature coaxial cable with a connector; the coaxial cable having an axially aligned center conductor, and the coaxial cable having a distal end; and the connector having a connector center conductor having a pin-shaped first end and a receiving means for receiving the center conductor of the coaxial cable disposed at the second end of the connector center conductor; the fixture for terminating a miniature coaxial cable comprising:

(a) a base;

(b) a first beam and a second beam, each having a distal end and each secured to the base with the first beam spaced from and opposing the second beam by a spacing less than a length of said pin-shaped first end;

(c) a first bore formed through the distal end of the first beam, and a second bore formed through the distal end of the second beam, said first and second bores being axially aligned said first and second bores sized to slidably and removably receive said pin-shaped first end within said bores;

(d) a third beam secured to the base, and having a distal end, said third beam opposing said second beam on a side thereof opposite said first beam; and (e) a cutout proximate the distal end of the third beam and being approximately axially aligned with the first and second bores, said cutout sized to releasably receive said cable whereby the pin-shaped end at the connector center conductor is insertable in the two axially aligned first and second bores with the receiving means being disposed toward the third beam and the coaxial cable is insertable in the cutout with the distal end of the coaxial cable being disposed toward and proximate the receiving means so that the center conductor of the coaxial cable is insertable in the receiving means.

2. The fixture for terminating a miniature coaxial cable in accordance with claim 1, wherein the third beam has a V-shaped notch opening upward in the distal end of the third beam for guiding the coaxial cable into the cutout.

3. The fixture for terminating a miniature coaxial cable in accordance with claim 1, further comprising attachment means for attaching the fixture to a working surface.

4. The fixture for terminating a miniature coaxial cable in accordance with claim 3, wherein the attachment means include at least one opening through the base and at least one fastener for inserting into the opening to attach the base to the working surface.

5. A fixture for terminating a miniature coaxial cable with a connector, and a kit for use with the fixture; the coaxial cable having a distal end and including a center conductor; and the connector including a connector center conductor having a pin-shaped first end and a receiving means for receiving the center conductor disposed at a second end; the fixture for terminating a miniature coaxial cable and kit comprising:

(a) a base;

(b) a first beam and a second beam each having a distal end, said first and second beams secured to said base with said first and second beams opposing one another and spaced apart by a spacing less than a length of said pin-shaped first end;

(c) a first bore formed through the distal end of the first beam, and a second bore formed through the distal end of the second beam, and said first and second bores being axially aligned;

(d) a third beam secured to the base on a side of said second beam opposite said first beam, and having a distal end and having a cutout proximate the distal end, the cutout of the third beam being approximately axially aligned with the first and second bores, said cutout sized to releasably receive said cable;

(e) a working surface; and (f) attachment means for attaching the fixture to the working surface.

6. The fixture for terminating a miniature coaxial cable with a connector, and a kit for use with the fixture in accordance with claim 5, wherein the attachment means includes at least one opening through the base and at least one fastener for inserting into the opening to attach the base to the working surface.

7. The fixture for terminating a miniature coaxial cable with a connector, and a kit for use with the fixture in accordance with claim 5, wherein the third beam has a V-shaped notch opening upward in the distal end of the third beam for guiding the coaxial cable into the cutout.

8. The fixture for terminating a miniature coaxial cable with a connector, and a kit for use with the fixture in accordance with claim 5, further comprising a connecting means for supporting the working surface.

9. The fixture for terminating a miniature coaxial cable with a connector and a kit for use with the fixture, in accordance with claim 5, further comprising a tray having at least one compartment, the tray being operably connected to the working surface.

* * * * *